US008724839B2

(12) United States Patent
Harano et al.

(10) Patent No.: US 8,724,839 B2
(45) Date of Patent: May 13, 2014

(54) UNIDIRECTIONAL MICROPHONE

(75) Inventors: Hiroyuki Harano, Osaka (JP); Hiroshi Yamagata, Osaka (JP); Kazuo Ono, Osaka (JP); Kensuke Nakanishi, Osaka (JP)

(73) Assignee: Hosiden Corporation, Osaka (JP)

( * ) Notice: Subject to any disclaimer, the term of this patent is extended or adjusted under 35 U.S.C. 154(b) by 4 days.

(21) Appl. No.: 13/500,217

(22) PCT Filed: Sep. 9, 2010

(86) PCT No.: PCT/JP2010/065506

§ 371 (c)(1),
(2), (4) Date: Apr. 4, 2012

(87) PCT Pub. No.: WO2011/043156

PCT Pub. Date: Apr. 14, 2011

(65) Prior Publication Data

US 2012/0195453 A1 Aug. 2, 2012

(30) Foreign Application Priority Data

Oct. 6, 2009 (JP) ..... 2009-232179

(51) Int. Cl.
*H04R 19/01* (2006.01)

(52) U.S. Cl.
USPC ..... 381/357; 381/356; 381/191

(58) Field of Classification Search
USPC ..... 381/113, 158, 174, 191, 354–357, 398, 381/313; 181/158
See application file for complete search history.

(56) References Cited

U.S. PATENT DOCUMENTS

| | | | | |
|---|---|---|---|---|
| 2003/0064687 | A1 | 4/2003 | Sugino et al. | |
| 2004/0109579 | A1 | 6/2004 | Izuchi et al. | |
| 2007/0189574 | A1 * | 8/2007 | Suzuki | 381/396 |
| 2009/0129621 | A1 | 5/2009 | Izuchi et al. | |
| 2009/0185697 | A1 | 7/2009 | Matsui | |

FOREIGN PATENT DOCUMENTS

| | | |
|---|---|---|
| CN | 1409528 | 4/2003 |
| CN | 101500187 | 8/2009 |
| GB | 2218303 | 11/1989 |
| JP | S48-15065 | 4/1973 |

(Continued)

OTHER PUBLICATIONS

First office action issued Jun. 3, 2013 for corresponding Korean patent application No. 10-2012-7008656.

(Continued)

*Primary Examiner* — Curtis Kuntz
*Assistant Examiner* — Joshua A Kaufman
(74) *Attorney, Agent, or Firm* — Greenblum & Bernstein, P.L.C.

(57) ABSTRACT

A unidirectional microphone includes a cylindrical capsule, a front plate blocking one end of the cylindrical capsule, a front plate sound hole formed in the front plate, a vibrating membrane and a first rear pole plate that are housed in the cylindrical capsule and form capacitance, a substrate blocking another open end of the capsule, and a rear plate sound hole formed in the substrate. The front plate sound hole and the rear plate sound hole are placed on mutually opposite sides of a central axis of the capsule so as to be offset relative to the central axis. The directional axis can be significantly offset relative to the central axis of the microphone using the microphone alone.

4 Claims, 5 Drawing Sheets

(56) References Cited

FOREIGN PATENT DOCUMENTS

| | | |
|---|---|---|
| JP | S55-130476 | 3/1979 |
| JP | 05-260586 | 10/1993 |
| JP | 2003-110676 | 11/2003 |
| JP | 2004-201291 | 7/2004 |
| JP | 2006-333222 | 12/2006 |
| JP | 2009-100148 | 5/2009 |
| JP | 2009-182758 | 8/2009 |
| KR | 10-0722687 | 5/2007 |
| KR | 10-2008-0011648 | 2/2008 |

OTHER PUBLICATIONS

Extended European Search Report issued Jun. 6, 2013 for corresponding European patent application No. 10821827.2.

First office action issued May 7, 2013 for corresponding Japanese patent application No. 2009-232179.

Korea Office action, dated Dec. 5, 2013 along with an english translation thereof.

China Office action, dated Feb. 8, 2014 along with an english translation thereof.

* cited by examiner

UNIDIRECTIONAL MICROPHONE

TECHNICAL FIELD

The present invention relates to an electrostatic unidirectional microphone.

BACKGROUND ART

A unidirectional microphone generally has a directional axis aligned with its central axis.

Patent literature 1 describes a structure in which two unidirectional microphones of this type are used to effectively obtain stereo sounds. In the structure in patent literature 1, for example, two sound holes (primary sound hole and secondary sound hole) offset relative to the central axis of the microphone is disposed in a holder for holding the microphone so that the directional axis is offset relative to the central axis of the microphone. In the structure, the primary sound hole and the secondary sound hole are placed on mutually opposite sides of the central axis of the microphone so that the directional axis is tiled from the central axis of the microphones to increase the angle formed by the directional axes of the two microphones.

PRIOR ART LITERATURE

Patent Literature

[Patent literature 1] Japanese Patent Application Laid Open No. 2006-333222

SUMMARY OF THE INVENTION

Problems to be Solved by the Invention

The offsetting of the directional axis in the above patent literature 1 is performed by adjustment of the positions of the sound holes (sound paths) in the holder of the microphone assembly including the microphone and the holder for holding the microphone. That is, the directional axis of the microphone is not offset by the microphone alone and the holder (additional component) attached to the microphone is used to offset the directional axis. Since the additional component is used, the number of components increases and reduction in thickness is prevented.

The present invention addresses the above problems with object of providing a unidirectional microphone in which the directional axis can be tilted relative to the central axis of the microphone by using the microphone alone so as to have a directional axis significantly offset relative to the central axis.

Means to Solve the Problems

According to the present invention, a unidirectional microphone includes a cylindrical capsule, a front plate blocking one end of the cylindrical capsule, a front plate sound hole formed in the front plate, a vibrating membrane and a rear pole plate that are housed in the cylindrical capsule and form capacitance, a substrate blocking another open end of the capsule, and a rear plate sound hole formed in the substrate, in which the front plate sound hole and the rear plate sound hole are placed on mutually opposite sides of a central axis of the capsule so as to be offset relative to the central axis.

Effects of the Invention

According to the present invention, since the directional axis can be significantly offset relative to the central axis of the microphone using the microphone alone, the number of components can be reduced and reduction in thickness can be achieved, as compared with a conventional microphone that offsets the directional axis by adjusting the positions of sound holes using the holder for holding the microphone.

DETAILED DESCRIPTION OF THE EMBODIMENTS

An embodiment of the present invention will be described below.

Figure 1A:
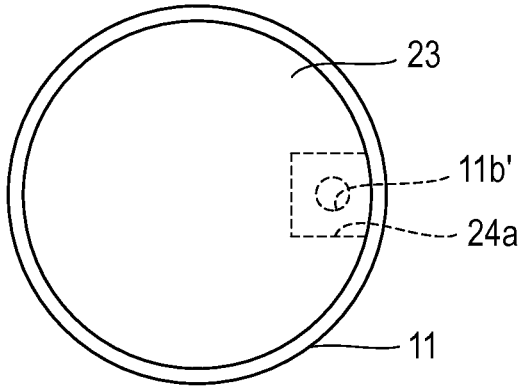
FIG. 1A is a plane view showing an embodiment of a unidirectional microphone according to the present invention.
Figure 1B:
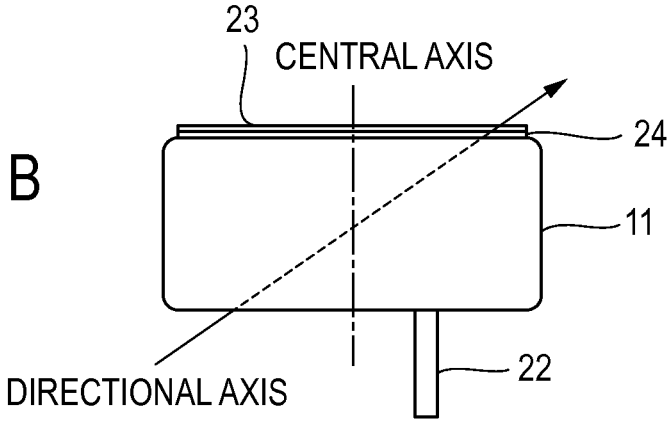
FIG. 1B is a front view showing the unidirectional microphone in FIG. 1A.
Figure 1C:
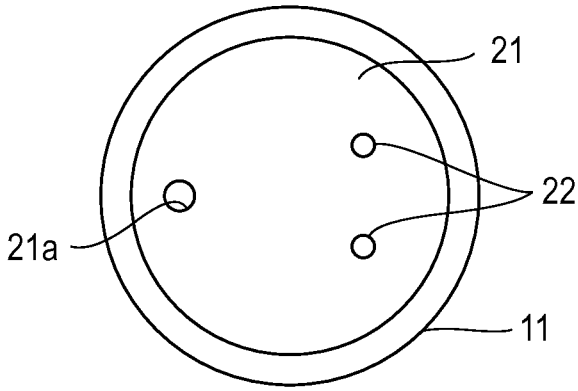
FIG. 1C is a bottom view showing the unidirectional microphone in FIG. 1A.
Figure 2:
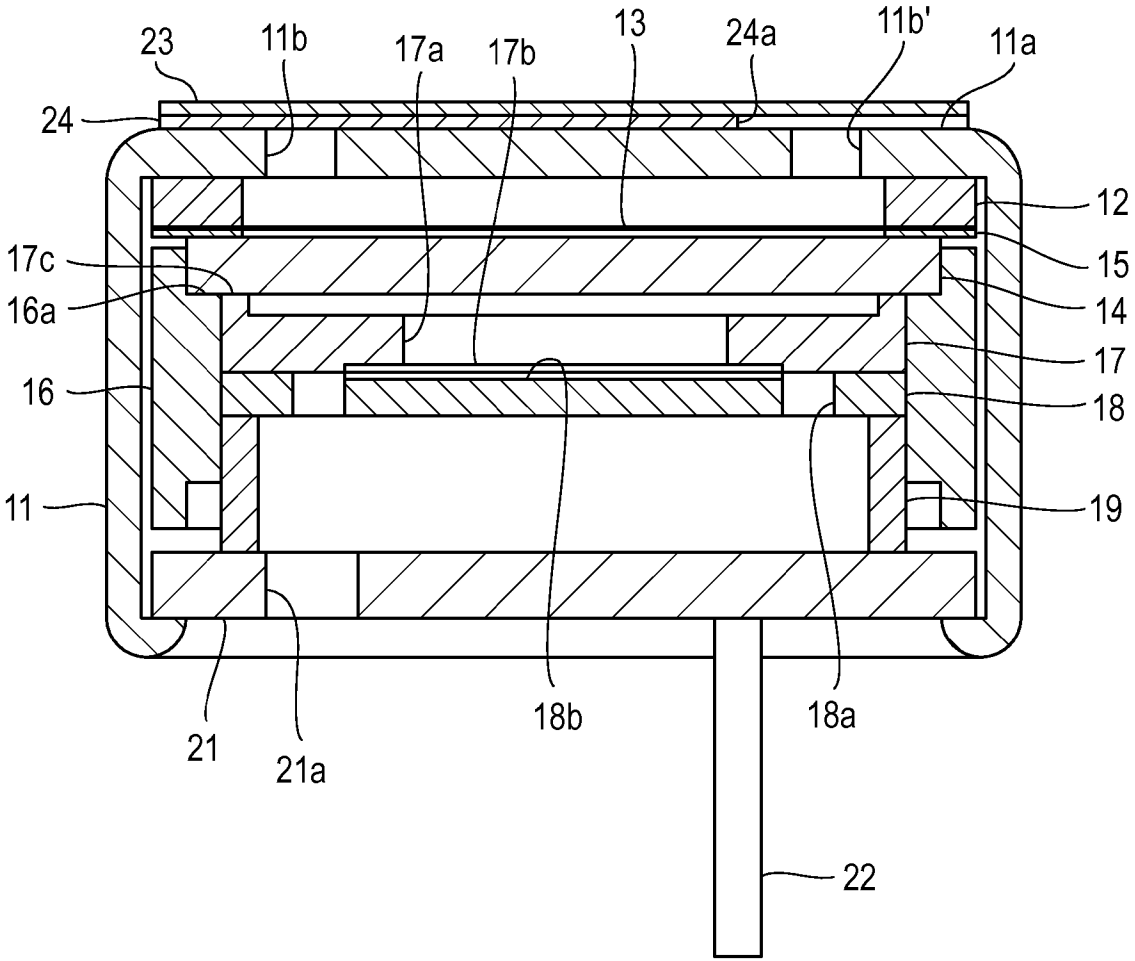
FIG. 2 is an enlarged sectional view showing the unidirectional microphone in FIG. 1A.
Figure 3:
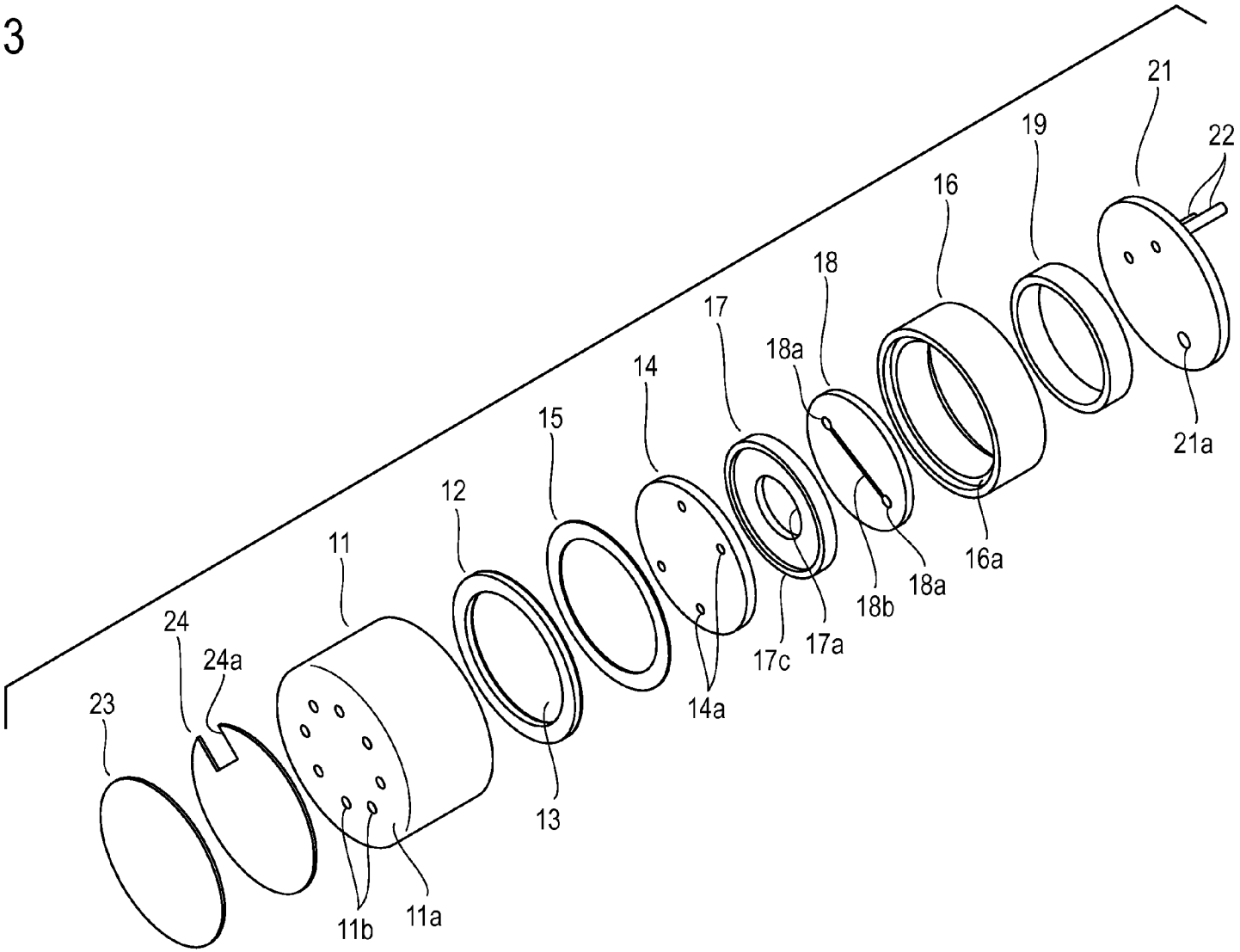
FIG. 3 is an exploded perspective view showing the unidirectional microphone in FIG. 1A.

FIGS. 1A, 1B, and 1C show the appearance of a unidirectional microphone according to the embodiment of the present invention; FIG. 2 shows the structure of a section of the unidirectional microphone; FIG. 3 shows the dismounted components.

A capsule 11 is cylindrical and made of metal material such as aluminum. The one end of the capsule 11 is blocked by a front plate 11*a* and many through holes 11*b* are formed in the front plate 11*a*. The through holes 11*b* are arranged at even angular intervals on a single circle about the central axis of the capsule 11 and the number of through holes 11*b* is 8 in this example.

The capsule 11 houses a vibrating membrane 13 attached to a vibrating membrane ring 12 made of metal material and the vibrating membrane ring 12 abuts against the front plate 11*a*. A first rear pole plate 14, which faces the vibrating membrane 13 to capacitance, faces the vibrating membrane 13 through a ring spacer 15 made of insulating material. A plurality of rear pole plate holes 14*a* are formed in the first rear pole plate 14. In this example, an electret dielectric membrane (not shown) is deposited on a surface of the first rear pole plate 14 that faces the vibrating membrane 13.

A step 16*a* is formed around the inside perimeter at the upper end of a cylindrical holder 16 made of insulating material and the first rear pole plate 14 securely mates with the step 16*a* so as to be held by the holder 16. The holder 16 houses a gate terminal 17 made of metal material and a second rear pole plate 18 in this example. The gate terminal 17 and the second rear pole plate 18 form an acoustic resistance.

Figure 4A:
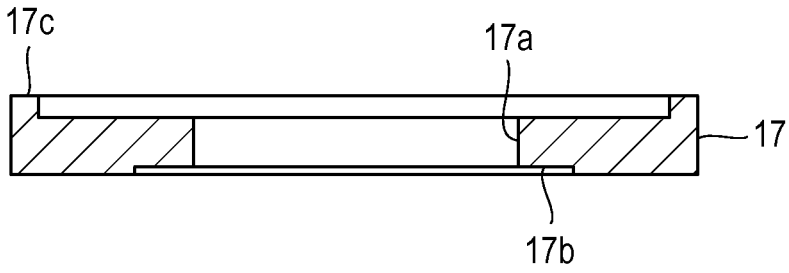
FIG. 4A is a sectional view showing the structure of a gate terminal.

The gate terminal 17 is a doughnut-shaped plate having an opening 17*a* at the center, and a circular step 17*b*, which is slightly lower, is formed around the opening 17*a* on one side of the gate terminal 17, as shown in FIG. 4A. A circular projection 17*c* is formed around the periphery on the other side.

Figure 4B:
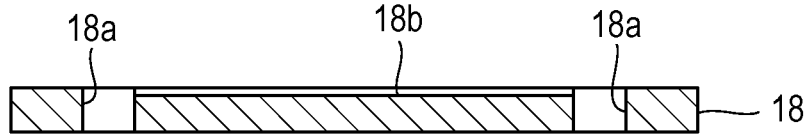
FIG. 4B is a sectional view showing the structure of a second rear pole plate.

The second rear pole plate 18 is discoid and two rear pole plate holes 18*a* are formed in this example; a V-shaped groove 18*b* is formed on one side between the two rear pole plate holes 18*a* as shown in FIG. 4B.

Figure 4C:
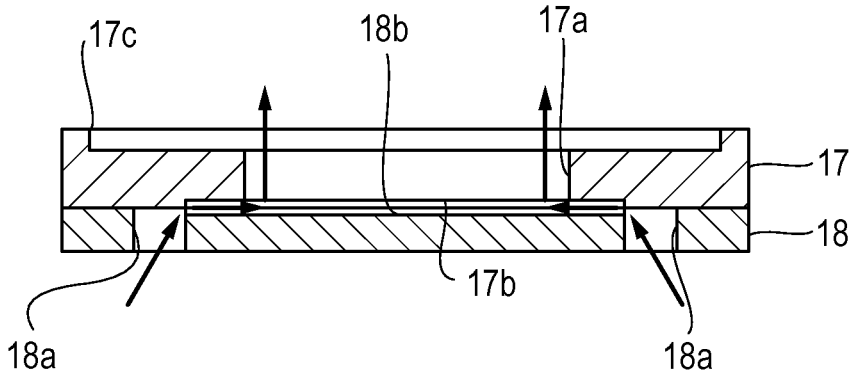
FIG. 4C shows an acoustic resistance formed by the gate terminal and the second rear pole plate.

The V-shaped groove 18*b* of the second rear pole plate 18 and the step 17*b* of the gate terminal 17 are placed so as to faces each other to form an acoustic resistance as shown in FIG. 4C.

The holder 16 further houses a gate ring 19, the lower end of which is mounted on a substrate 21. One rear plate sound hole 21*a* is formed in a position on the substrate 21 significantly offset relative to the central axis of the capsule 11 and the substrate 21 covers the other end of the opening of the capsule 11. A device (not shown) such as an IC chip is mounted on an inner surface of the substrate 21. Two terminal pins 22 pass through the substrate 21 and soldered securely.

In assembling of components in the capsule 11, the vibrating membrane ring 12 holding the vibrating membrane 13, the spacer 15, and the holder 16 to which the first rear pole plate 14 is secured are assembled in sequence. Then, the gate terminal 17, the second rear pole plate 18, the gate ring 19, and the substrate 21 are assembled; the open end of the capsule 11 is bent around the perimeter of the outer surface of the substrate 21 to caulk it. The vibrating membrane 13 is connected to the circuit of the substrate 21 through the vibrating membrane ring 12 and the capsule 11, and the first rear pole plate 14 is connected to the circuit of the substrate 21 through the gate terminal 17, the second rear pole plate 18, and the gate ring 19.

On the other hand, a compensation cloth 23 is attached to an outer surface of the front plate 11*a* of the capsule 11. The compensation cloth 23 is attached through a double-sided adhesive tape 24. A notch 24*a* is disposed in a part of the perimeter of the double-sided adhesive tape 24. The through holes 11*b* formed in the front plate 11*a* except for one through hole 11*b* are covered with the double-sided adhesive tape 24 and the through hole 11*b* at the position of the notch 24*a* not covered with the double-sided adhesive tape 24 is used as a front plate sound hole 11*b*'.

The double-sided adhesive tape 24 adheres so that the notch 24*a* is aligned with the through hole 11*b* located in a position opposite to the rear plate sound hole 21*a* of the substrate 21 with respect to the central axis of the capsule 11 to make the through hole 11*b* function as the front plate sound hole 11*b*'. This makes the front plate sound hole 11*b*' and the rear plate sound hole 21*a* be significantly offset to each other with respect to the central axis of the capsule 11; in the positional relationship between the front plate sound hole 11*b*' and the rear plate sound hole 21*a*, the directional axis is significantly offset (tilted) with respect to the central axis (the central axis of the microphone) of the capsule 11 in this example as shown in FIG. 1B.

For example, it may be possible to dispose only one through hole (front plate sound hole) 11*b*' instead of many through holes 11*b* in the front plate 11*a* of the capsule 11 as shown in this example, but the front plate sound hole 11*b*' of the capsule 11 and the rear plate sound hole 21*a* of the substrate 21 need to be positioned to achieve a predetermined positional relationship when the open end of the capsule 11 is caulked during assembling of the microphone, so the positioning becomes complicated because it is not easy. In this example, however, the unnecessary through holes 11*b* are covered with the double-sided adhesive tape 24 after the capsule 11 is caulked to form the front plate sound hole 11*b*', so the complicated positioning for caulking the capsule 11 is unnecessary.

Eight through holes 11*b* are formed in the front plate 11*a* of the capsule 11 in the above example, but the number of the through holes 11*b* is not limited to eight, and more than eight through holes 11*b* may be formed, for example. In addition, an acoustic resistance is formed by the gate terminal 17 and the second rear pole plate 18, but the acoustic resistance may be formed by another configuration. For example, the acoustic resistance may be formed by replacing the substrate with a multi-layer board or urethane or cloth may be used as the acoustic resistance. An electret dielectric membrane is formed on the first rear pole plate 14 in the above example, but it may be deposited on the vibrating membrane 13 instead.

On the other hand, many through holes 11*b* are formed in the front plate 11*a* of the capsule 11 in the above example, one rear plate sound hole 21*a* is formed in a periphery of the substrate 21, and the through holes 11*b* in the front plate 11*a* except for one through hole 11*b* are blocked to form the front plate sound hole 11*b*'. However, one front plate sound hole 11*b*' may be formed in a periphery of the front plate 11*a* of the capsule 11, many through holes may be arranged on a single circle on the substrate 21, and the through holes may be restricted (blocked except for one through hole) to form the rear plate sound hole 21*a*. In this case, the through holes except for one through hole used as the rear plate sound hole 21*a* can be easily blocked by, for example, affixation of a single-sided adhesive tape etc. on the outer surface of the substrate 21.

Figure 5A:
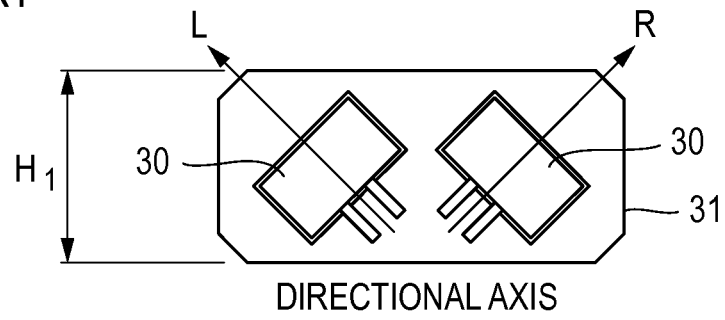
PRIOR ART FIG. 5A
FIG. 5A is an example of configuring a stereo microphone including two conventional unidirectional microphones.
Figure 5B:
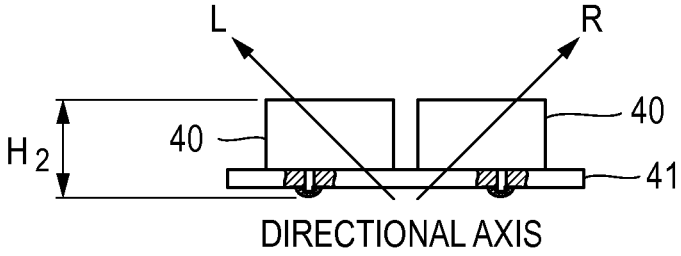
FIG. 5B is an example of configuring a stereo microphone including the two unidirectional microphones according to the present invention.

Each of FIGS. 5A and 5B shows an example of configuring a stereo microphone including two unidirectional microphones. FIG. 5A shows the structure in which a conventional unidirectional microphone 30 with its directional axis aligned with the central axis of the microphone is used; FIG. 5B shows the structure in which a unidirectional microphone 40 according to the present invention is used.

As shown in FIG. 5A, in the conventional structure, the directional axis of the unidirectional microphone 30 needs to become parallel with the surface of the substrate 31 to take the stereo angle formed by the L side and the R side of the unidirectional microphone 30 and the two unidirectional microphones 30 need to be mounted on the substrate 31 with their central axes tilted, so height $H_1$ cannot be reduced to a low value and reduction in thickness is difficult.

On the other hand, when the unidirectional microphone 40 according to the present invention is used, it is not necessary to take the stereo angle by tilting the two unidirectional microphones 40 as shown in FIG. 5B and the unidirectional microphones 40 can be mounted horizontally on the substrate 41, so height $H_2$ can be reduced to a low value and reduction in thickness is enabled in the mounting of the microphones 40.

What is claimed is:

1. A unidirectional microphone comprising:

a cylindrical capsule;

a front plate blocking one end of the cylindrical capsule;

a front plate sound hole formed in the front plate;

a vibrating membrane and a rear pole plate that are housed in the cylindrical capsule and form capacitance;

a substrate blocking another open end of the capsule; and a rear plate sound hole formed in the substrate;

wherein:

the front plate sound hole and the rear plate sound hole are placed on mutually opposite sides of a central axis of the capsule so as to be offset relative to the central axis, and many through holes are formed on a single circle on the front plate, a compensation cloth is attached to an outer surface of the front plate through a double-sided adhesive tape having a notch on a perimeter thereof, and one through hole of the many through holes that is aligned with the notch and not covered with the double-sided adhesive tape is used as the front plate sound hole.

2. The unidirectional microphone according to claim 1, wherein an electret dielectric membrane is disposed on one of the vibrating membrane and the rear pole plate.

3. A unidirectional microphone comprising:

a cylindrical capsule;

a front plate blocking one end of the cylindrical capsule;

a front plate sound hole formed in the front plate;

a vibrating membrane and a rear pole plate that are housed in the cylindrical capsule and form capacitance;

a substrate blocking another open end of the capsule; and a rear plate sound hole formed in the substrate, wherein:

the front plate sound hole and the rear plate sound hole are placed on mutually opposite sides of a central axis of the capsule so as to be offset relative to the central axis, and many through holes are formed on a single circle on the substrate and a single-sided adhesive tape having a notch on a perimeter thereof is adhered to an external surface of the substrate so that the many through holes except for one through hole that is used as the rear plate sound hole are covered with the single-sided adhesive tape.

4. The unidirectional microphone according to claim 3, wherein an electret dielectric membrane is disposed on one of the vibrating membrane and the rear pole plate.

* * * * *